United States Patent [19]

Ellison

[11] 4,052,995

[45] Oct. 11, 1977

[54] BLOWOUT PREVENTER RAM LOCK AND LOCKING METHOD

[75] Inventor: C. Mack Ellison, Houston, Tex.

[73] Assignee: Hydril Company

[21] Appl. No.: 605,857

[22] Filed: Aug. 19, 1975

[51] Int. Cl.[2] ..... E21B 33/06

[52] U.S. Cl. ..... 137/1; 92/17; 92/24; 92/27; 251/1 A; 251/94

[58] Field of Search ..... 251/1 R, 1 A, 94; 92/17, 24, 27, 28; 188/67; 137/1

[56] References Cited

U.S. PATENT DOCUMENTS

| | | | |
|---|---|---|---|
| 2,643,642 | 6/1953 | Geyer | 92/17 |
| 3,208,357 | 9/1965 | Allen et al. | 251/1 A X |
| 3,242,826 | 3/1966 | Smith | 92/24 |
| 3,267,818 | 8/1966 | Chambers | 92/17 |
| 3,353,455 | 11/1967 | Berry | 92/27 X |
| 3,738,229 | 6/1973 | Kraft | 92/17 |
| 3,941,141 | 3/1976 | Robert | 251/1 A X |
| 3,983,792 | 10/1976 | Furtner | 92/24 X |

*Primary Examiner*—Martin P. Schwadron
*Assistant Examiner*—Richard Gerard
*Attorney, Agent, or Firm*—Pravel, Wilson & Gambrell

[57] ABSTRACT

A new and improved ram lock for blowout preventer rams which permits locking of the ram at multiple and adjustable positions to compensate for wear on sealing elements of blowout preventer rams and increase sealing action of the ram without requiring separate special control lines. Automatic locking of the ram at a desired position, such as in sealing position, is obtained.

32 Claims, 7 Drawing Figures

Fig. 3
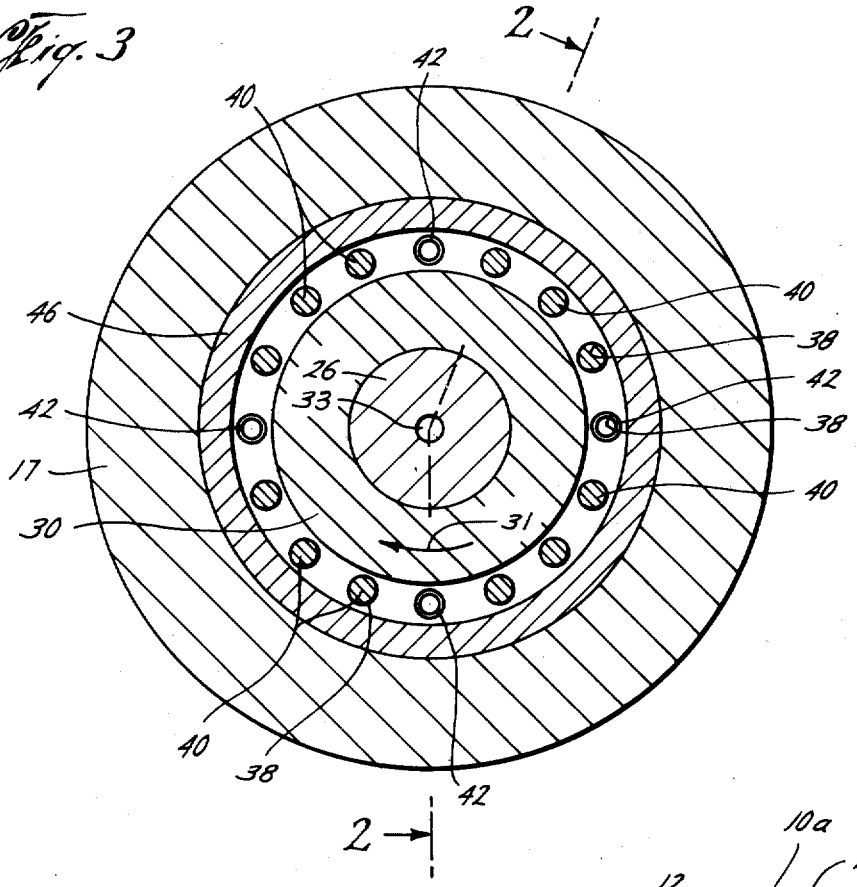
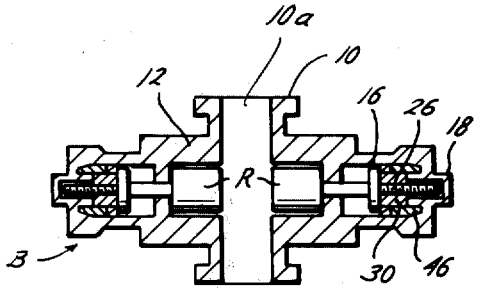
Fig. 1
Fig. 4
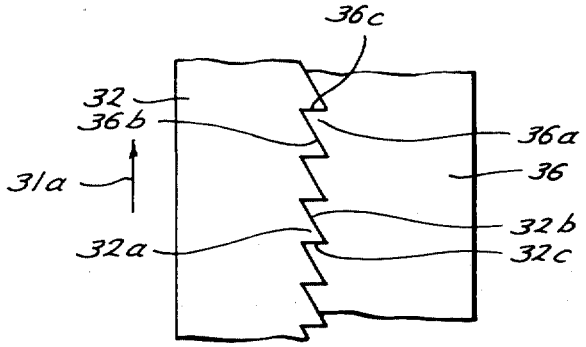

BLOWOUT PREVENTER RAM LOCK AND LOCKING METHOD

BACKGROUND OF THE INVENTION

The present invention relates to ram locks for blowout preventer rams.

In ram blowout preventers, each closure of the ram causes a certain amount of wear of the ram sealing elements which move into the borehole of the preventer for sealing contact with a pipe or other object, such as another ram. During succeeding closures of the rams, the effectiveness of the seal was reduced when the ram was locked in sealing position due to such wear.

Certain prior art blowout preventer ram locks, such as in U.S. Pat. No. 3,242,826 and Re27,294 used snap rings of collets mounted with a ram piston for locking. When the piston reached a predetermined locking position defined by a groove in the ram piston cylinder, the snap ring moved into the groove to lock the ram and piston in place. However, with this structure, only one locking position of the ram, as defined by the relative position of the snap ring and groove, was obtained. Change of the locking position to compensate for sealing element wear required adjustment of the relative positions of the locking elements, requiring undesirable disassembly of the blowout preventer cylinders for such adjustments to be made.

Other blowout preventer ram locks, such as in U.S. Pat. No. 3,208,357, used a tapered locking pin which moved into locking position behind the ram piston once the ram had been moved into sealing position. However, extra hydraulic operating and control lines, separate and distinct from those for causing ram piston movement, were required, increasing the complexity of the control system for those types of ram locks.

SUMMARY OF THE INVENTION

Briefly, the present invention provides a new and improved ram lock for blowout preventer rams which automatically locks the ram against outward movement during inward movement of the ram to a closed position in a bore of the blowout preventer, and further locks the ram at an adjustable closed position to achieve the desired degree of sealing contact with a well pipe or like object in the bore.

A ram carrier moves the ram through the blowout preventer to an initial closed position. A lock is continuously engaged with the ram carrier during movement thereof, permitting control of the movement of the ram carrier and ram and locking operation of the lock by means of a single operating control system of fluid lines.

The ram carrier moves in the preventer in response to opening and closing fluid pressures and has a threaded surface which continuously engages a similar threaded surface on a lock nut rotatably moving with respect to the ram carrier in the blowout preventer. The lock also includes a toothed lock nut ratchet ring mounted with and moving with the lock nut, and a restraining ratchet ring having ratchet teeth engaging the teeth of the lock nut ratchet ring. The ratchet teeth of the ratchet rings engage so that the ratchet rings and lock nut permit inward advance of the ram carrier to the closed position. A lock ring responsive to the closing fluid pressure locks with the blowout preventer body and also engages the teeth of the ratchet rings to automatically lock the ram carrier against reverse movement.

The lock ring further responds to opening fluid pressure by disengaging fromm the preventer body and moving with the lock nut and ratchet rings, with respect to the ram carrier, unlocking the ram and ram carrier and permitting the ram to move from the closed position in response to the opening fluid pressure.

Further, the lock nut and ram carrier threaded surfaces permit the ram carrier to be moved inwardly to an adjustable closed position while the lock automatically locks the ram and ram carrier in this adjustable closed position.

BRIEF DESCRIPTION OF THE DRAWINGS

FIG. 1 is a vertical sectional view of a ram blowout preventer according to the present invention;

FIG. 3 is a cross-sectional view along the lines 3—3 of FIG. 2;

FIG. 4 is a cross-sectional view along the lines 4—4 of FIG. 2;

Figure 2:
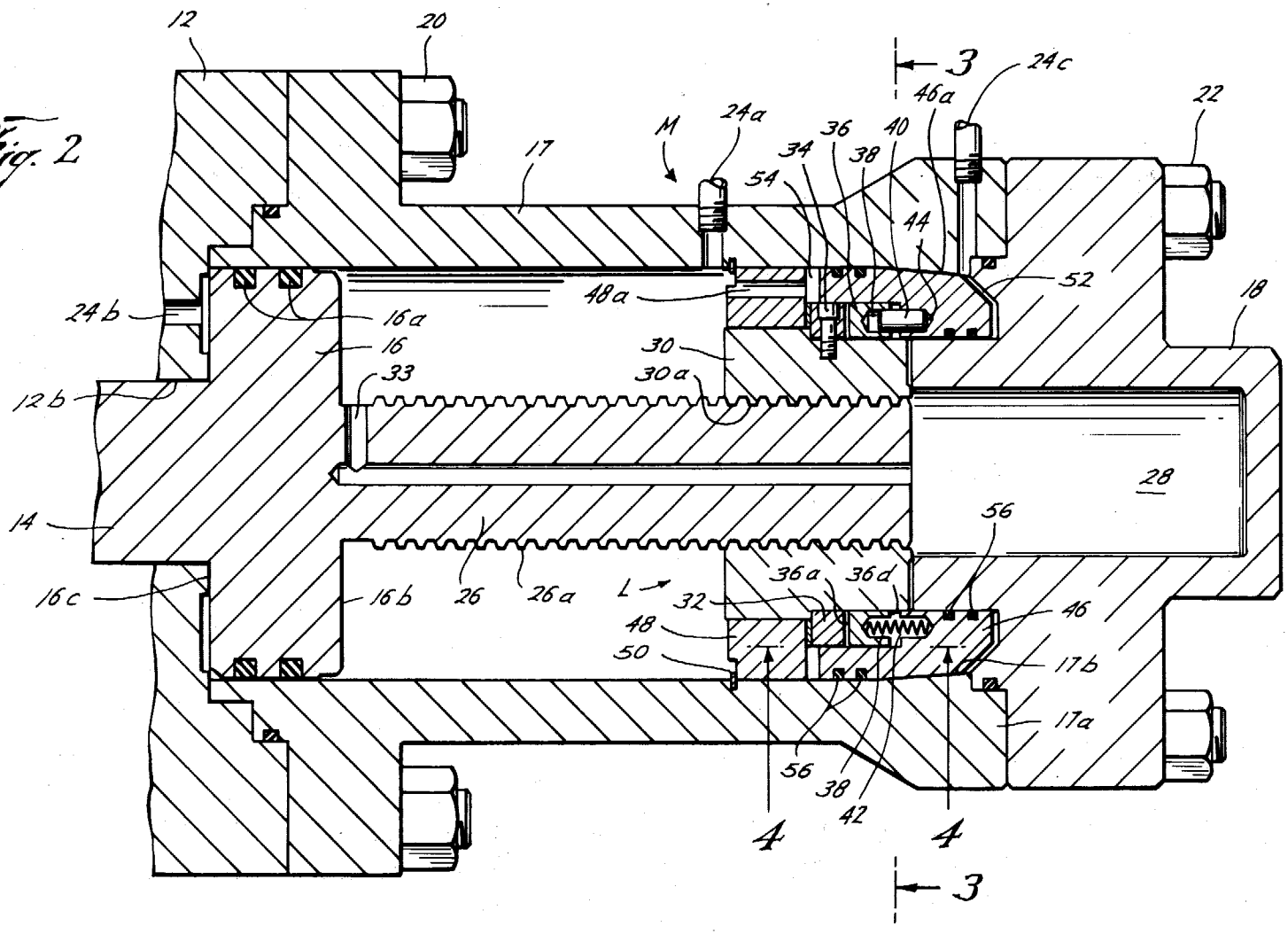
FIG. 2 is a vertical sectional view illustrating one embodiment of a ram blowout preventer and lock of this invention in the closed position or sealing position.

DESCRIPTION OF THE PREFERRED EMBODIMENT:

In the drawings, the letter B (FIG. 1) refers generally to a blowout preventer of this invention which is formed with a pair of rams R which are locked into place by a locking apparatus L of the present invention automatically at adjustable closed positions for sealing contact with the pipe or like object. The blowout preventer B is typically mounted in a stack of blowout preventers or in a string of well casing or pipe.

As is conventional, the rams R are disposed in a conventional blowout preventer body or housing 10 having a longitudinal well bore **10*a* therethrough, through which well pipe or other objects such as well tools may pass in normal operations conducted with the blowout preventer B in an open or retracted position (FIG. 1). In the open position, the rams R are mounted in conventional recesses in the body 10 adjacent the bore 10*a*. The rams R move in response to a motive or power means M from their respective recesses into an extended or closed position in the bore 10*a*** for sealing contact of conventional sealing elements with a well pipe, well tool, or another ram. The sealing elements of the ram are conventional and are carried by a conventional ram block of the ram R. Since the sealing elements and ram blocks are conventional, they are not shown in the drawings in order to more clearly show other structure.

The rams R may be any of several types of blowout preventer rams. For example, the rams R may be of the type known as "blind" rams for sealing against another "blind" ram of similar structure; the type wherein the sealing inner portions of the rams are shaped for sealing about a pipe or well tool in the bore, as well as with one another on each side of the pipe or well tool; or the shear-seal ram type for shearing tubing or objects in the bore **10*a* in conjunction with a similar shear seal ram and thereafter sealing the bore 10*a*** of the preventer B against well pressure.

A conventional head or bonnet 12 (FIG. 2) is connected to each side of the body or housing 10 and each of such heads or bonnets has a conventional recess aligned with the recesses in the housing or body 10 so that the rams R may be received in such recesses when they are in the retracted or open position (FIG. 1). A piston rod 14 (FIG. 2) extends through suitable sealing structure in an opening **12*b* (FIG. 2) of each head or bonnet 12. Each piston rod 14 extends to a piston or ram carrier 16 of conventional construction which is disposed in a ram piston cylinder 17 with O-rings 16*a* or other suitable seals therebetween. The piston 16 moves in response to the motive means M within the cylinder 17** in a manner to be set forth.

The ram piston 17 is mounted with the bonnet 12 by bolts 20 or other suitable fastening means. Similarly, a cylinder head cap or end closure 18 is mounted with the ram piston cylinder 17 by bolts 22 or other suitable fastening means.

For purposes of illustration, in the preferred embodiment, the motive means M includes a fluid inlet line **24*a* (FIG. 2) shown for introducing air, hydraulic fluid or other operating fluid pressure into the cylinder 17 against an outer surface 16*b* of the piston 16 for moving the piston 16 inwardly (to the left as viewed in FIGS. 2 and 2A) to move the rams R toward the center of the bore 10*a*. An opening fluid conduit 24*b* is formed through the body of the bonnet 12 for introducing air, hydraulic fluid or other operating fluid pressure into the cylinder 17 against an inner surface 16*c* (FIG. 2A) of the piston 16 for moving the piston 16 outwardly (to the right as viewed in FIGS. 2 and 2A) to retract the ram R from the closed position in the bore 10*a***.

It should be understood that various systems for providing operating or motive power to the blowout preventer B may be employed and the invention is not limited to the specific form illustrated in the drawings. It should also be understood that a similar power means is provided for the left-hand ram as viewed at FIG. 1 in the same manner as the power means illustrated for the right-hand ram R in FIG. 2.

An unlocking control fliudi conduit **24*c* commonly connected in fluid communication with the source of operating fluid pressure provided through the conduit 24*b* is connected for introducing operating fluid pressure into the cylinder 17** for unlocking the lock L, in a manner to be set forth.

It should be understood that although the fluid conduits **24*a* and 24*c* are shown schematically as separate conduits from the bonnet 12 and cylinder 17, they may be formed by conventional techniques as integral portions of the bonnet 12 and cylinder 17**.

A piston tail rod 26 of the ram piston 16 extends rearwardly from the piston 16 and moves into and out of an opening 28 in the cylinder head 18, as the piston 16 (FIG. 2A) moves in response to the power means M. The piston tail rod 26 has a threaded external surface **26*a* formed thereon which is continuously engaged with a threaded inner surface 30*a* of a lock nut 30** of the lock L.

The threaded surfaces **26*a* of the tail shaft 26 and 30*a* of the lock nut 30 engage so that the lock nut rotates in a clockwise direction (as indicated by an arrow 31 in FIG. 3) in response to inward movement of the piston 16. As will be set forth below, the lock L resists rearward movement of the piston 16 until unlocked, at which time the threaded surfaces 26*a* and 30*a* cause the lock nut 30 to move in a reverse or counter-clockwise direction in response to outward movement of the piston 16**.

A fluid conduit 23 is formed in the piston tail rod 26 to provide fluid communication between the space in the cylinder 17 rearward of the surface **16*b* on the piston 16 and the opening 28 in the cylinder head 18 so that operating fluid introduced through the fluid inlet 24*a* may pass into the opening 28 to assist in inward movement of the ram piston 16**.

The lock L further includes a cylindrical lock nut ratchet ring 32 fixedly mounted with the lock nut 30 by means of locking screws 34 or other suitable locking means so that the ratchet ring 32 moves with the lock nut 30. The lock nut ratchet ring 32 has ratchet teeth **32*a* (FIG. 4) formed on a rear surface thereof whih are selectively engageable in a manner to be set forth with opposing ratchet teeth 36*a* of a cylindrical taper lock ratchet ring 36**.

The ratchet teeth **32*a* on the ratchet ring 32 have a sloping ramp surface 32*b* (FIG. 4) formed thereon which contacts a conforming sloping ramp surface 36*b* of the teeth 36*a* on the ratchet ring 36. The ratchet teeth 32*a* and 36*a* each further have a planar stop surface 32*c* and 36*c*, respectively, formed between their adjacent ramp surfaces 32*b* and 36*b***.

The ratchet ring 32 is fixedly mounted with the lock nut 30, as has been set forth, and the engaged sloping ramp surfaces **32*b* and 36*b* permit the ratchet ring 32 to move clockwise therewith, as indicated by an arrow 31*a* (FIG. 4) when the piston 16** moves inwardly.

Figure 2A:
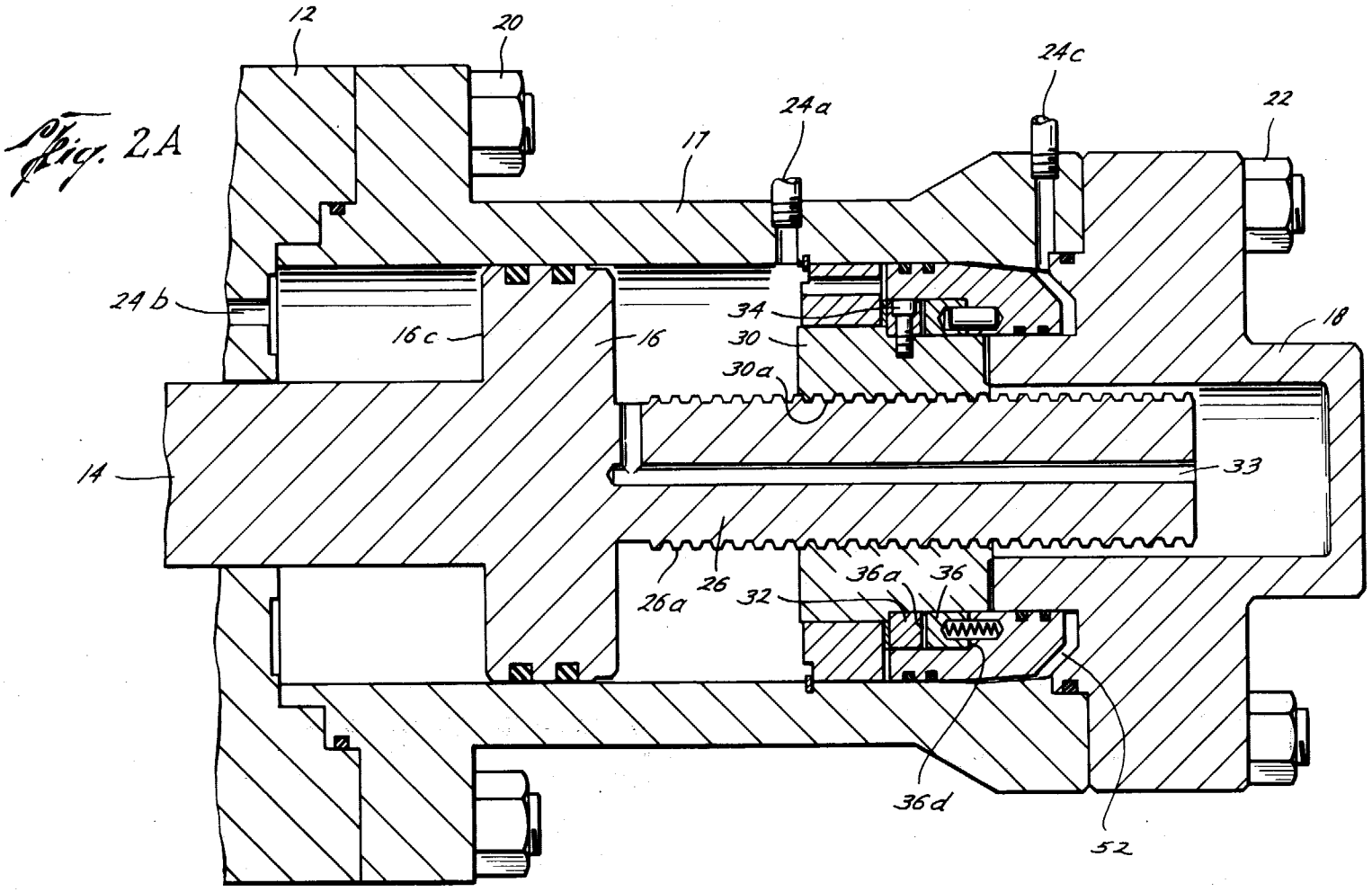
FIG. 2A is a vertical sectional view of the blowout preventer of FIG. 2.

The taper lock ratchet ring 36 has a plurality of inwardly extending mounting sockets 38 formed therein on an opposite surface **36*d* FIG. 2A) from the ratchet teeth 36*a* for receipt of linking or anti-rotation pins 40 in certain of the sockets 38 and load springs 42 or other suitable resilient means in the remaining sockets 38 (FIG. 3**).

The anti-rotation pins 40 and the loading springs 42 extend outwardly from the sockets 38 in the taper lock ratchet 36 into substantially aligned sockets 44 formed in a tapered lock ring 46, which is movable from a fixed locking position (FIG. 2) to a movable unlocking position (FIG. 2A) in a manner to be set forth.

The anti-rotation pins 40 interconnect the lock ring 46 and taper ratchet ring 36 when the lock ring is in both the fixed locking position (FIG. 2) and the movable unlocking position (FIG. 2A). The anti-rotation pins 40 prevent relative movement between the lock ring 46 and the taper ratchet ring 36 when the lock ring 46 is in the fixed locking position (FIG. 2), but permit the taper ratchet ring 40 and lock ring 46 to move together in the movable unlocking position (FIG. 2A).

The load springs 42 urge the ratchet teeth **36*a* into engagement with the ratchet teeth 32*a* when the lock ring 46 is in both the unlocking position and in the locking position. In the locking position of lock ring 46, the ratchet ring 32 moves with the lock nut 30 during inward movement of the piston 16 and the resilient load springs 42 yield sufficiently to permit relative rotational movement between the sloping surfaces 32*b* and 36*b* of the ratchet teeth 32*a* and 36*a*, permitting relative ratchet movement between the ratchet rings 32 and 36 when the piston 16** moves inwardly.

During the inward movement of the piston 16 with the lock ring 46 in the locking position, the ratchet ring 32 and lock nut 30 are automatically locked against rearward movement of the piston 16 due to forces such as well bore pressures and the like by engagement of the ratchet teeth 32a and 36a along planar surfaces 32c and 36c. The ratchet teeth 32a and 36a are maintained in engagement by the force of the load springs 42 and the interconnection between the taper ratchet ring 36 and lock ring 46 by the anti-rotation pins 40.

A cylindrical retaining ring 48, held in place against inward and outward movement with respect to the lock nut 30 by means of a snap ring 50 or other suitable structure, retains the ratchet rings 34 and 36 and the lock ring 46 in an unlocking fluid chamber 52 formed between a rear portion 17a of the cylinder 17 and the end closure 18. The unlocking fluid chamber 52 is in fluid communication with the unlocking fluid inlet 24c (FIG. 2). Suitable fluid ports 48a (FIG. 2) are formed in the retaining ring 48 to permit operating fluid pressure from the inlet 24a into the cylinder 17 to pass into a locking chamber 54 in the lock L for reasons to be set forth. O-rings 56 or other suitable sealing means are mounted between the lock ring 46, the cylinder 17 and the cylinder head 18 to prevent fluid communication betwen the unlocking chamber 52 and the locking chamber 54.

The lock ring 46 moves from the locking position (FIG. 2) to the unlocking position (FIG. 2A) in response to the introducton of operating fluid pressure into the unlocking chamber 52 through inlet 24c. The lock ring 46 moves from the unlocking position to the locking position in response to operating fluid pressure in the locking chamber 54. The lock ring 46 has a rearwardly tapering cam surface 46a adapted to engage and wedge in the locking position with a co-acting tapered cam surface 17b on an inner wall of the cylinder 17 in response to fluid pressure in the locking chamber 54. The lock ring 46 is thereafter retained in the locked position wedged against the surface 17b, even should fluid pressure in the locking chamber 54 be abated, until fluid pressure is introduced into the unlocking chamber 52.

In the operation of the blowout preventer B with the lock L, when it is desired to move the ram R inwardly from the open position (FIG. 1) to the closed position (FIG. 2), operating fluid pressure is provided through the fluid inlet 24a to act on the ram piston 16 and move the ram R inwardly. The operating fluid introduced into the cylinder 17 from the inlet 24a concurrently passes through the ports 48a in the retaining ring 48 into the locking chamber 54 of the lock L, moving the locking ring 46 rearwardly to the locking position where the surface 46a of locking ring 46 locks with the co-acting tapered surface 17a of the cylinder 17. Engagement of the lock ring 46 in the locking position occurs during initial stages of inward movement of the piston 16 from the open position, for reasons to be set forth.

Locking fluid pressure further passes from the cylinder 17 through the conduit 33 in the tail shaft 26 of the piston 16, during inward movement thereof, into the socket 28 in the cylinder head 18 to assist in inward movement of the piston 16.

With the lock ring 46 moved into the locking position (FIG. 2) with the surface 17a of the cylinder 17 fromm the outset of inward movement of the piston 16, contact is maintained between the ratchet ring teeth 32a and 36a by the load springs 42. In this manner, during all stages of inward advance of the piston 16 with respect to the bore 10a of the preventer B, the lock ring 30 freely rides and rotates with respect to the piston tail shaft 26 permitting continuous inward advance of the ram R due to the ratchet engagement of the sloped ratchet teeth 32b and 36b of the ratchet rings 32 and 36.

However, at all positions of the ram R with respect to the bore 10a during such inward movement, the flat surfaces 32a and 36c of the ratchet ring teeth 32a and 36a are engaged and locked against any rearward force on the piston 16, locking so that the ram R is locked and restrained against such rearward movement. In this manner, the lock L automatically locks the ram piston 16 and the ram R against rearward movement at any position during inward movement thereof. It is to be noted that this automatic locking of the lock L occurs in response to the same fluid pressure which moves the piston 16 inwardly, since the lock L is continuously engaged with the piston 16, and thus without the need for a separate and distinct locking fluid control system from that of the moving fluid system.

Further, once the ram R has reached an initial sealing position contacting a well pipe or other object in the bore 10a of the preventer B, it is possible to compensate for wear of the blowout preventer sealing material. Once the initial closed position has been reached with the ram block forcing the ram sealing elements into an initial seal with the object in the object bore 10a, increased pressure is introduced through the fluid inlet 24a to act on the ram piston 16 and move the piston 16 and ram R further inwardly. The ram R is moved further inwardly in this manner with the ram block 7 forcing the sealing elements 7 thereof into closer engagement with the object in the bore 10a increasing the feed of the sealing elements into contact with the object to compensate for any wear or loss of the sealing elements until the desired degree of sealing contact between the object in the bore and the ram R is obtained. It is to be noted that with the threaded contact between the tail shaft 26 of the piston 16 and the lock nut 30 the adjustable locking position obtained with the lock L may be selectively varied over an entire range of positions to achieve the desired seal in contrast to a number of discrete and fixed positions. It is further to be noted that automatic mechanical locking of the lock L is maintained during movement of the ram R to the adjustable closed position.

Once the ram R is in the desired sealing position, the pressure of the operating fluid in the fluid inlet 24a may be abated and the ram R remains locked in the sealed position automatically by the lock L due to the lock ring 46 remaining in the locked position (FIG. 2) with the surface 17b of the cylinder 17.

When it becomes desirable or necessary to unlock the ram R from the adjustable closed position, suitable unlocking fluid pressure is provided through the fluid inlets 24b and 24c. As has been set forth, these inlets receive fluid from a common fluid supply, and simultaneously act. The fluid pressure through the inlet 24b acts on the inner surface 16b of the piston 16 to move such piston and the ram R rearwardly with respect to the blowout preventer B. However, without the presence of operating fluid pressure through the fluid inlet 24c to the unlocking chamber 52, rearward movement of the piston 16 is prevented due to the automatic locking feature of the lock L set forth above. As the fluid is received in the unlocking chamber 52, however, the lock ring 46 moves inwardly and out of locking engagement with the cylinder 17 to the unlocked position (FIG. 2A), permitting the lock ring 46 and the ratchet ring 38 connected therewith by the pins 40 to simultaneously move with the lock nut 30 and lock nut ratchet ring 36 due to the engagement between the flat portions 32c and 36c of ratchet teeth 32a and 36a, respectively. Thus, the piston 16 is permitted to move rearwardly while the lock nut 30 and lock ring 46 freely rotate with respect to the threaded surface of the piston tail shaft 26, permitting rearward movement of the piston 16 with respect to blowout preventer B.

In an alternative embodiment lock L-1 (FIGS. 5 and 5A) in a blowout preventer, like structure to that of the lock L performing like functions bears like reference numerals.

In the lock L-1, a piston 116 moves within a guide sleeve 102 mounted in a ram piston cylinder 117 from an open position (FIG. 5) through a partially closed position (FIG. 5A) to an adjustable closed position for achieving desired sealing contact of sealing elements of the ram R with an object or other ram in the well bore of the blowout preventer B.

The piston cylnder 117 is mounted with a bonnet 112 by bolts 20 or other suitable fastening means. Further, the piston cylinder 117 has a cylinder head 118 mounted therewith by bolts 22 or other suitable fastening means.

Figure 5:
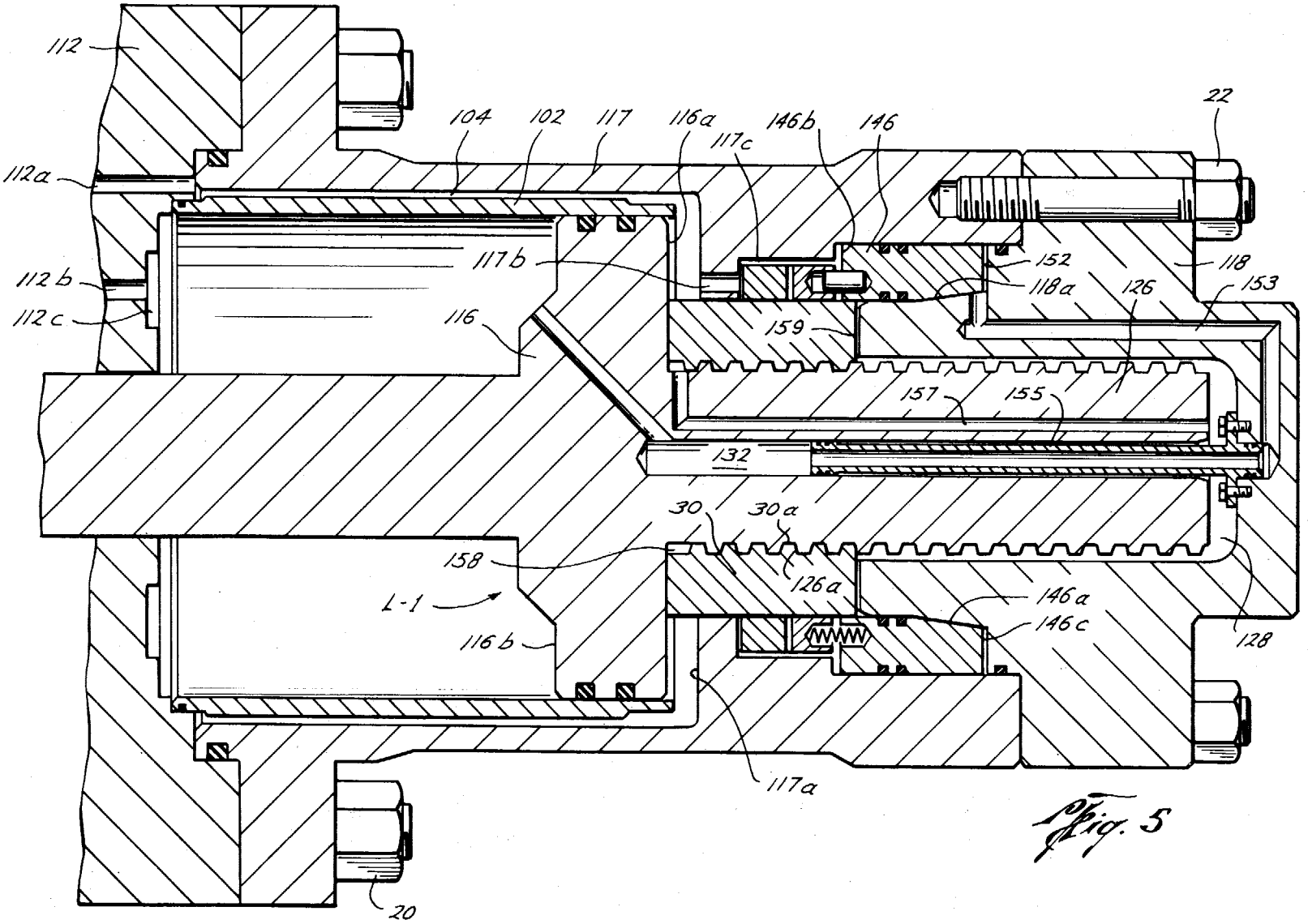
FIG. 5 is a vertical sectional view of another embodiment of a ram blowout preventer and lock of the present invention in open position.

The bonnet 112 has fluid inlets 112a formed therein for introduction and passage of operating fluid pressure into a space 104 between the sleeve 102 and cylinder 117 to a space within the sleeve 102 adjacent a rear surface 116a of the piston 116 in the sleeve 102 to move the piston 116 inwardly from the open position (FIG. 5). The bonnet 112 further has opening fluid inlets 112b formed therein for introduction and passage of operating fluid pressure into a space within the sleeve 102 adjacent a front surface 116b of the piston 116. For ease in initial rearward movement of the piston 116, the fluid inlets 112b may be enlarged as indicated by pockets 112c. The piston 116 has an unlocking fluid passage 132 formed therein for conveying unlocking operating fluid pressure from the space adjacent the surface 116b rearwardly through the piston 116 to the lock L-1 as will be set forth.

In the lock L-1, the piston 116 has a piston tail shaft 126 with a threaded external surface 126a formed thereon. A lock nut 30 of the lock L-1 has a threaded surface 30a continually engaging the threaded surface 126a of the piston tail shaft 126.

A lock nut ratchet ring 32 with ratchet teeth 32a is fixedly mounted by suitable means with the lock nut 30 for movement therewith. The ratchet ring 32 has sloped surfaces 32b and flat surfaces 32c on the ratchet teeth 32a which engage conforming surfaces 36b and 36c of ratchet teeth 36a (FIG. 4) of the taper lock ratchet ring 36 in response to load spring 42. An inner shoulder 117a is formed in the ram piston cylinder 117 to retain the ratchet rings 32 and 36 in position with respect to the lock nut 30 and other elements of the lock L-1 to be set forth. The shoulder 117a has suitable ports 117b formed therein for passage of operating fluid therethrough to cause locking operation of the lock L-1 as will be set forth.

Anti-rotation pins 40 and loading springs 42 are mounted with the ratchet ring 36 and interconnect such ratchet ring with a lock ring 146. The ratchet teeth 32a and 36a of the ratchet rings 32 and 36 are configured to permit continuously adjustable inward relative movement of the piston 116 with respect to the lock nut 30 in response to locking fluid pressure in the manner set forth for the lock L. The ratchet teeth 32a and 36a lock and resist relative rearward movement of the piston 116 with respect to the lock nut 30 at any of multiple adjustable selected locking pistons. This locking operation occurs when a tapered surface 146a of the locking taper ring 146 is moved and wedged into locking engagement with a mating tapered locking surface 118a formed within the locking cylinder head 118. This locking movement occurs in response to the introduction of locking fluid pressure through the port 117b into a locking chamber 117c within the ram piston cylinder 117, which fluid pressure acts on an inner surface 146b of the locking taper ring 146 to move such taper rearwardly into locking position (FIG. 5).

Figure 5A:
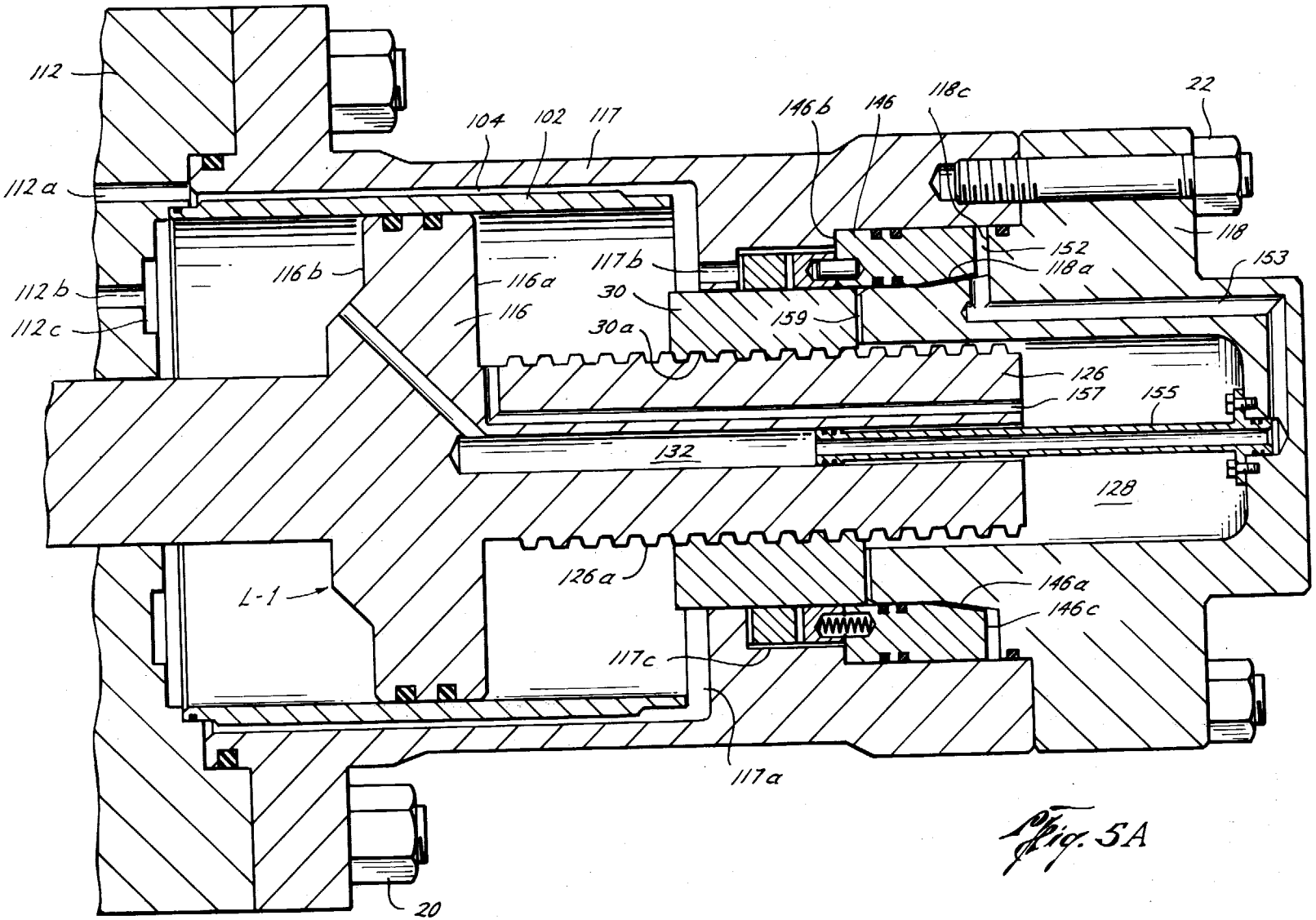
FIG. 5A is a vertical sectional view of the blowout preventer of FIG. 5 in a partially open position.

An unlocking chamber 152 (FIG. 5A) in the lock L-1 is formed between a rear surface 146c of the locking taper ring 146 and the locking taper surface 118a and a rear surface 118c (FIG. 5A). The unlocking chamber 152 is connected through a fluid conduit 153 formed in the cylinder head 118 to a fluid feeding sleeve 155. The fluid feeding sleeve 155 is mounted within a piston receiving chamber 128 formed within the cylinder head 118. The fluid feed sleeve 155 extends inwardly into the unlocking fluid passage 132 formed in the piston 116 with suitable seals formed at the inner end thereof to permit the opening or unlocking fluid to pass from the inlets 112b through the iston 116 and the conduit 153 to the unlocking chamber 152.

A fluid venting port 157 is formed in the piston tail shaft 126 of the piston 116 and provides a vent or outlet passage for fluid which might inadvertently be trapped in a pocket 158 between the lock nut 30 and tail shaft 126 and resist locking movement. Fluid is permitting to flow from the chamber 158 through the port 157 to a passage 159 into the locking chamber 117c within the ram piston cylinder and therefrom through the ports 117b into the space 104 between the guide sleeve 102 and ram piston cylinder 117.

As with the lock L, when operating fluid pressure is introduced in the lock L-1 into the cylinder 117 the piston 116 moves inwardly to move the ram R into the closed position. The operating fluid pressure also moves the locking taper 146 into the locking position, automatically locking the lock L-1 so that relative rearward rotational movement between the ram piston shaft 126 and the lock nut 30 of the lock L-1 is prevented by the locking action of the lock ring 146 and the engaged flat teeth 32c and 36c of the ratchet rings 32 and 36.

It is to be noted, however, that relative inward movement of the piston 116 with respect to the blowout preventer B continues subsequent to the locking interaction between the lock ring 146 and locking taper 118a. This inward movement occurs due to the sliding engagement of tapered surfaces 32b and 36b of the ratchet ring teeth 32a and 36a, in the manner set forth, permitting movement of the ram R to an adjustable closed position, so that sealing contact of the ram R may be adjusted to achieve the desired sealing pressure with the object in the bore 10a.

In unlocking the lock L-1, opening or unlocking fluid is introduced into the unlocking chamber 152 through the conduit 153 and fluid feeding sleeve 155, and the locking ring 146 is moved inwardly from the locking position (FIG. 5) to the unlocking position (FIG. 5A). In this unlocking position, as with the lock L, the lock nut 30, ratchet rings 32 and 36 and lock ring 146 are mechanically interconnected for unrestrained relative rotational movement together in response to rearward movement of the piston 116. Accordingly, in response to unlocking fluid pressure, the lock L-1 freely rotates with respect to the threaded shaft 126a of the ram piston 116 permitting relative rearward movement to unlock the ram R.

The foregoing disclosure and description of the invention are illustrative and explanatory thereof, and various changes in the size, shape and materials as well as in the details of the illustrated construction may be made without departing from the spirit of the invention.

I claim:

1. In a blowout preventer having at least one blowout preventer ram, a ram lock for locking the ram at an adjustable closed position for sealing contact with a well pipe or the like in a bore of the blowout preventer, comprising:

a. a ram carrier means comprising a ram piston having a piston rod with a threaded surface formed thereon for moving the ram to an initial closed position in the blowout preventer in response to closing fluid pressure;

b. lock means continuously engaged with said ram carrier means during movement thereof and permitting movement of said ram carrier means to the initial closed position and the adjustable closed position of the ram to increase the sealing contact thereof to a desired level, said lock means comprising:

1. a lock nut having a threaded surface formed thereon and engaged by said threaded surface on said ram piston rod for rotational movement with respect thereto during movement of the ram to the closed position;

2. a lock nut ratchet ring fixedly mounted with said lock nut for movement therewith, said lock nut ratchet ring having ratchet teeth formed thereon;

3. a restraining ratchet ring having ratchet teeth formed thereon; and 4. said teeth of said lock nut ratchet ring and said restraining ratchet ring permitting unrestrained movement of the ram to the closed position, and further being energizable to lock the ram against reverse movement; and c. means for energizing said lock means to lock the ram in place at the adjusted closed position comprising means responsive to the closing fluid pressure to energize said lock means, wherein the ram is locked at adjustable sealing positions by said lock means.

2. The structure of claim 1, wherein said means for energizing comprises:

a lock ring having means therewith for moving said teeth of said lock nut ratchet ring and said restraining ratchet teeth into engagement to lock the ram against reverse movement in response to the losing fluid pressure moving said ram carrier means to the closed position.

3. The structure of claim 1, wherein opening fluid pressure is introduced against said ram carrier means to move the ram outwardly from the closed position, and wherein:

said means for energizing further comprises means responding to the opening fluid pressure to unlock the ram from the closed position.

4. The structure of claim 3, wherein:

said lock nut is engaged by said threaded surface on said ram piston rod for rotational movement with respect thereto during outward movement from the closed position.

5. The structure of claim 4, wherein:

said teeth of said lock nut ratchet ring and said restraining ratchet ring are engageable to resist reverse movement of the ram piston in the absence of opening fluid pressure against said ram carrier means.

6. The structure of claim 5, wherein said means for energizing comprises:

a lock ring adapted for movement in response to opening fluid pressure to a position permitting rotational movement of said ratchet rings and said lock nut with respect to said ram piston rod during outward movement of the ram from the closed position to unlock the ram.

7. The structure of claim 1, wherein:

said means for energizing comprises means responsive to the closing fluid pressure moving said ram carrier means to automatically energize said lock means to lock the ram in place.

8. The structure of claim 1, wherein the preventer has at least a pair of rams, and wherein each of the rams has a ram lock for locking the ram at an adjustable closed position for sealing contact with a well pipe or the like in a bore of the blowout preventer, comprising:

a. ram carrier means comprising a ram piston having a piston rod with a threaded surface formed thereon for moving the ram into an initial closed position in the blowout preventer in response to closing fluid pressure;

b. lock means continuously engaged with said ram carrier means during movement thereof and permitting movement of said ram carrier means to the initial closed position and the adjustable closed position of the ram to increase the sealing contact thereof to a desired level, said lock means comprising:

1. a lock nut having a threaded surface formed thereon and engaged by said threaded surface on said ram piston rod for rotational movement with respect thereto during movement of the ram to the closed position;

2. a lock nut ratchet ring fixedly mounted with said lock nut for movement therewith, said lock nut ratchet ring having ratchet teeth formed thereon;

3. a restraining ratchet ring having ratchet teeth formed thereon; and 4. said teeth of said lock nut ratchet ring and said restraining ratchet ring permitting unrestrained movement of the ram to the closed position, and further being energizable to lock the ram against reverse movement; and c. means for energizing said lock means to lock the ram in place at the adjusted closed position comprising means responsive to the closing fluid pressure to energize said lock means, wherein the ram is locked at adjustable sealing positions by said lock means.

9. In a blowout preventer having at least one blowout preventer ram, a ram lock for automatically locking the ram against reverse or outward movement during initial movement to a closed position for contact of the ram with a well pipe or the like in a bore of the blowout preventer, comprising:

a. ram carrier means comprising a ram piston having a piston rod with a threaded surface formed thereon for moving the ram to an initial closed position in the blowout preventer in response to closing fluid pressure;

b. means for permitting inward advance of said ram carrier means and the ram through the blowout preventer to the closed position of the ram, comprising:
1. a nut having a threaded surface formed thereon and engaged by said threaded surface on said ram piston rod for rotational movement with respect thereto during movement of the ram to the closed position;
2. a lock ratchet ring fixedly mounted with said nut for movement therewith, said lock ratchet ring having ratchet teeth formed thereon;
3. a restraining ratchet ring having ratchet teeth formed thereon; and
4. said teeth of said lock ratchet ring and said restraining ratchet ring automatically engaging to lock the ram against outward movement; and c. lock means for automatically restraining outward movement of said piston means in a direction opposite the inward advance, wherein said piston is automatically locked against such outward movement.

10. The structure of claim 9 further including:
means for automatically moving said teeth of said ratchet ring and said restraining ratchet ring into engagement and resisting relative movement therebetween in response to the closing fluid pressure.

11. The structure of claim 10, wherein opening fluid pressure is introduced against said ram carrier means to move the ram outwardly from the closed position, and wherein:
said lock means comprises means responsive to the opening fluid pressure for unlocking said ram carrier means and the ram for permitting outward movement.

12. The structure of claim 11, wherein said means for automatically moving further comprises:
means for moving into engagement with said restraining ratchet ring and said lock ratchet ring for movement therewith in response to opening fluid pressure thereby unlocking said ram carrier means and the ram for outward movement.

13. The structure of claim 9, wherein:
said threaded surfaces on said ram piston rod and said lock nut are relatively movable to permit incremental movement of the ram to adjustable closed positions, wherein the ram is automatically locked at adjustable closed positions.

14. The structure of claim 9, wherein the preventer has at least a pair of rams, and wherein each of the rams has a ram lock for automatically locking the ram against reverse or outward movement during inward movement to a closed position for contact of the ram with a well pipe or the like in a bore of the blowout preventer, comprising:

a. ram carrier means comprising a ram piston having a piston rod with a threaded surface formed thereon for moving the ram to an initial closed position in the blowout preventer in response to closing fluid pressure;

b. means for permitting inward advance of said ram carrier means and the ram through the blowout preventer to the closed position of the ram, comprising:
1. a nut having a theaded surface formed thereon and engaged by said threaded surface on said ram piston rod for rotational movement with respect thereto during movement of the ram to the closed position;
2. a lock ratchet ring fixedly mounted with said nut for movement therewith, said lock ratchet ring having ratchet teeth formed thereon;
3. a restraining ratchet ring having ratchet teeth formed thereon; and
4. said teeth of said lock ratchet ring and said restraining ratchet ring automatically engaging to lock the ram against outward movement; and c. lock means for automatically restraining outward movement of said piston means in a direction opposite the inward advance, wherein said piston is automatically locked against such outward movement.

15. A method of automatically locking a blowout preventer ram during inward movement of the ram to a closed position for contact of the ram with a well pipe or the like in a bore of a blowout preventer, comprising the steps of:

a. moving the ram inwardly with closing fluid pressure towards the closed position in a blowout preventer; and b. with the closing fluid pressure automatically locking the ram and thereby restraiing outward movement of the ram in a direction opposite the movement of said step of moving at multiple and adjustable positions to thereby automatically lock the ram against such outward movement.

16. The method of claim 15, wherein the closed position of the ram is adjustable to achieve desired sealing contact thereof with the well pipe or the like and said step of moving the ram inwardly comprises the step of:

a. moving the ram inwardly to an initial closed position with the closing fluid pressure; and b. incrementally moving the ram further inwardly to achieve desired sealing contact thereof.

17. A ram lock for a blowout preventer ram for locking the ram at an adjustable closed position for sealing contact with a well pipe or the like in the blowout preventer, comprising:

a. ram carrier means comprising a ram piston having a piston rod with a threaded surface formed thereon for moving the ram to an initial closed position in the blowout preventer in response to closing fluid pressure;

b. lock means continuously engaged with said ram carrier means during movement thereof and permitting movement of said ram carrier means to the initial closed position and the adjustable closed position of the ram to increase the sealing contact thereof to a desired level, said lock means comprising:
1. a lock nut having a threaded surface formed thereon and engaged by said threaded surface on said ram piston rod for rotational movement with respect thereto during movement of the ram to the closed position;
2. a lock nut ratchet ring fixedly mounted with said lock nut for movement therewith, said lock nut ratchet ring having ratchet teeth formed thereon;
3. a restraining ratchet ring having ratchet teeth formed thereon; and
4. said teeth of said lock nut ratchet ring and said restraining ratchet ring permitting unrestrained movement of the ram to the closed position, and further being energizable to lock the ram against reverse movement; and c. means for energizing said lock means to lock the ram in place at the adjusted closed position, wherein the ram is locked at adjustable sealing positions by said lock means.

18. The structure of claim 17, wherein said means for energizing comprises:

a lock ring for moving said teeth of said lock nut ratchet ring and said restraining ratchet ring into engagement to lock the ram against reverse movement.

19. The structure of claim 17, wherein:

said means for energizing comprises means responsive to the closing fluid pressure to energize said lock means.

20. The structure of claim 19, wherein:

said teeth of said lock nut ratchet ring and aid restraining ratchet ring are relatively movable to permit unrestrained movement of the ram to the closed position, and further are engageable to lock the ram against reverse movement in response to said means for energizing.

21. The structure of claim 20, wherein said means for energizing comprises:

a lock ring having means therewith for moving said teeth of said lock nut ratchet ring and said restraining ratchet ring into engagement to lock the ram against reverse movement in response to the fluid pressure moving said ram carrier means to the closed position.

22. The structure of claim 17, wherein opening fluid pressure is introduced against said ram carrier means to move the ram outwardly from the closed position, and wherein:

said means for energizing comprises means responding to the opening fluid pressure to unlock the ram from the closed position.

23. The structure of claim 22, wherein:

said lock nut is mounted with said ram piston rod for rotational movement with respect thereto during outward movement from the closed position.

24. The structure of claim 23, wherein:

said teeth of said lock nut ratchet ring and said restraining ratchet ring are engaged to resist reverse movement of the ram piston in the absence of opening fluid pressure against said ram carrier means.

25. The structure of clam 24, wherein said means for energizing comprises:

a lock ring adapted for movement in response to opening fluid pressure to a position permitting rotational movement of said ratchet rings and said lock nut with respect to said ram piston rod during outward movement of the ram from the closed position to unlock the ram.

26. The structure of claim 17, wherein opening fluid pressure is introduced against said ram carrier means to move the ram from the closed position, and wherein said means for energizing comprises:

a. means responsive to the closing fluid pressure to energize said lock means; and b. means responsive to the opening fluid pressure to unlock the ram.

27. The structure of claim 17, wherein:

said means for energizing comprises means responsive to the closing fluid pressure moving said ram carrier means to automatically energize said lock means to lock the ram in place.

28. A ram lock for a blowout preventer ram for automatically locking the ram against reverse or outward movement, during inward movement to a closed position for contact of the ram with a well pipe or the like in a bore of a blowout preventer, comprising:

a. ram carrier means comprising a ram piston having a piston rod with a threaded surface formed thereon for moving the ram to an initial closed position in the blowout preventer in response to fluid pressure;

means for permitting inward advance of said ram carrier means and the ram through the blowout preventer to the closed position of the ram, comprising:

1. a nut having a threaded surface formed thereon and engaged by said threaded surface on said ram piston rod for rotational movement with respect thereto during movement of the ram to the closed position;

2. a lock ratchet ring fixedly mounted with said nut for movement therewith, said lock ratchet ring having ratchet teeth formed thereon;

3. a restraining ratchet ring having ratchet teeth formed thereon; and 4. said teeth of said lock ratchet ring and said restraining ratchet teeth automatically engaging to lock the ram against outward movement; and c. lock means for automatically restraining outward movement of said piston means in a direction opposite the inward advance, wherein said piston is automatically locked against such outward movement.

29. The structure of claim 28, further including:

means for automatically moving said teeth of said lock ratchet ring and said restraining ratchet ring into engagement and resisting relative movement therebetween in response to the closing fluid pressure.

30. The structure of claim 29, wherein opening fluid pressure is introduced against said ram carrier means to move the ram outwardly from the closed position, and wherein:

said lock means comprises means responsive to the opening fluid pressure for unlocking said ram carrier means and the ram for permitting outward movement.

31. The structure of claim 30, wherein said means for automatically moving further comprises:

means for moving into engagement with said restraining ratchet ring and said lock ratchet ring for movement therewith in response to opening fluid pressure thereby unlocking said ram carrier means and the ram for outward movement.

32. The structure of claim 28, wherein:

said threaded surfaces on said ram piston rod and said lock nut are relatively movable to permit incremental movement of the ram to adjustable closed positions, wherein the ram is automatically locked at adjustable closed positions.

* * * * *